United States Patent [19]

Kiese

[11] Patent Number: 4,761,963

[45] Date of Patent: Aug. 9, 1988

[54] METHOD OF EXCHANGING THE DISPLACEMENT ELEMENT OF A REFRIGERATOR AND REFRIGERATOR FOR IMPLEMENTING THE METHOD

[75] Inventor: Gerhard Kiese, Cologne, Fed. Rep. of Germany

[73] Assignee: Leybold Aktiengesellschaft, Cologne, Fed. Rep. of Germany

[21] Appl. No.: 79,110

[22] Filed: Jul. 29, 1987

[30] Foreign Application Priority Data

Jul. 29, 1986 [EP] European Pat. Off. ..... 86110463.6

[51] Int. Cl.[4] ..... F25B 45/00

[52] U.S. Cl. ..... 62/77; 62/298; 62/6

[58] Field of Search ..... 62/6, 298, 77, 292, 62/326

[56] References Cited

FOREIGN PATENT DOCUMENTS

| | | | |
|---|---|---|---|
| 119846 | 3/1984 | European Pat. Off. | 62/298 |
| 2153404 | 10/1971 | Fed. Rep. of Germany | 62/298 |
| 3120233 | 12/1982 | Fed. Rep. of Germany | 62/298 |
| 29389 | 7/1951 | Luxembourg | 62/298 |
| 1554724 | 10/1979 | United Kingdom | 62/298 |

*Primary Examiner*—Henry A. Bennett

*Attorney, Agent, or Firm*—Spencer & Frank

[57] ABSTRACT

A method of exchanging the displacement element of a refrigerator having a divided housing whose parts can be separated from one another in such a manner that the displacement element becomes accessible, and a refrigerator structure which facilitates the method. In order to be able to exchange the displacement element in the cold state without the danger of condensation in the displacement element chamber, a stream of protective gas is maintained during opening of the housing, during the exchange of the displacement element and during closing of the housing so that undesirable gases are unable to penetrate into the displacement element work chamber. To facilitate the method, one of the parts of the housing has the work chamber formed therein and high and low pressure gas ports are provided in this part. The low pressure gas port is provided further than the high pressure gas port from an end of the work chamber which is open when the parts are separated, and the stream of protection gas is applied to the work chamber through the low pressure gas port.

3 Claims, 1 Drawing Sheet

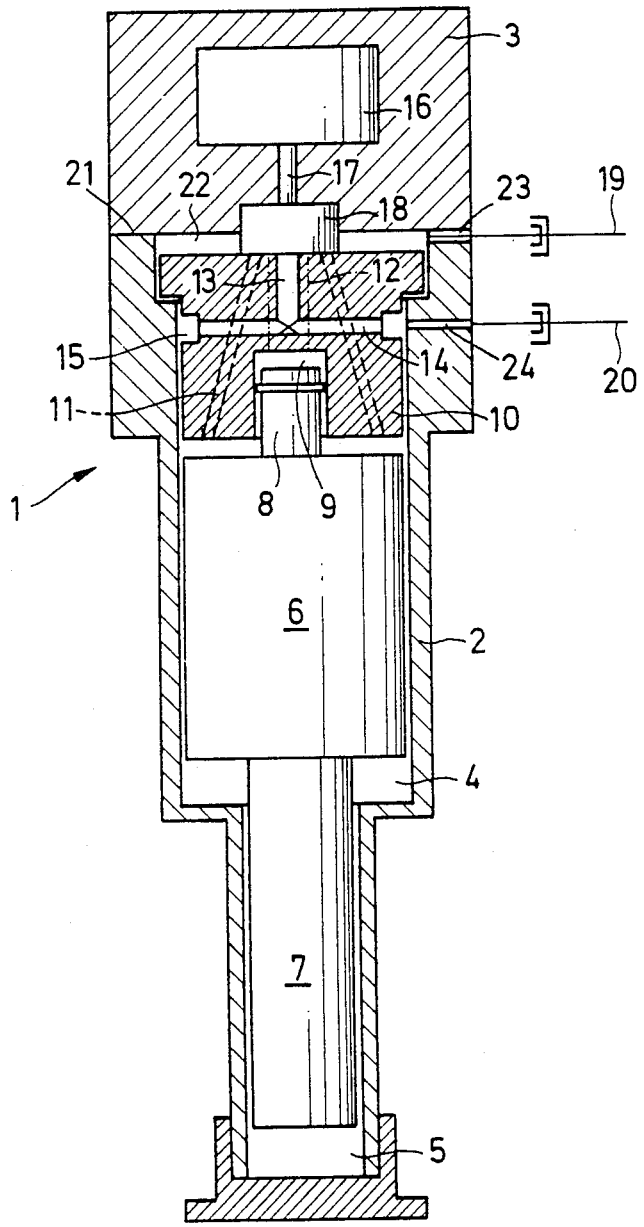
3
16
17
21
22
18
23
19
13
12
15
14
24
20
11
10
1
8
9
6
2
4
7
5

METHOD OF EXCHANGING THE DISPLACEMENT ELEMENT OF A REFRIGERATOR AND REFRIGERATOR FOR IMPLEMENTING THE METHOD

BACKGROUND OF THE INVENTION

The present invention relates to a method of exchanging the displacement element of a refrigerator having a divided housing whose parts can be separated from one another in such a manner that the displacement element becomes accessible. Additionally, the invention relates to a refrigerator designed for implementation of the method.

Refrigerators of this type are low-temperature cooling machines in which thermodynamic circulation processes take place. A single-stage refrigerator essentially comprises a work chamber including a displacement element. The work chamber is connected in a certain manner alternatingly with a high pressure and a low pressure gas source so that the thermodynamic circulation process takes place during the enforced back and forth movement of the displacement element. This causes the operating gas to be conducted in a closed circuit. The result is that heat is extracted from a certain region of the work chamber. In two-stage refrigerators of this type and with helium as the working gas, temperatures down to less than 10° K. can be produced.

For repair and maintenance work there often arises the need to exchange the displacement element. This can be done in such a manner that the refrigerator is shut down and the cold regions of the refrigerator are permitted to warm up to room temperature. Without warm-up, condensible gases would precipitate at the cold surfaces and would endanger the renewed operation of the refrigerator. Since the temperatures at the cold locations of a refrigerator operated with helium are only a few degrees K, the presence of almost all gases normally occurring in the atmosphere are undesirable. After sufficient heating, the housing is opened and the displacement element is exchanged. After closing and thorough rinsing of the housing with the working gas, the refrigerator is put back into use.

A change of displacement elements effected in this manner takes a very long time since the warm-up periods and the restarting periods are added to the actual work times. Moreover, operation of the device or an instrument cooled by the refrigerator is interrupted during these times. For instruments filled with a large amount of liquid helium (100 liters and more) warming the refrigerator merely for an exchange of displacement elements is unfeasible for economic reasons. It requires removal of the liquid helium.

To avoid long interruptions of operation, it is known to effect the change of displacement elements with the aid of a glove box. The use of a glove box makes it possible to effect the exchange of displacement elements in a protective gas atmosphere. In this way, for example, condensible gases can be prevented from penetrating into the work or cylinder chamber of the displacement element and condensing at regions that are still cold. The use of the glove box has the advantage that the exchange of displacement elements can be effected at even lower temperatures, i.e., it is not necessary to wait for the cold regions of the refrigerator and the connected apparatus or instrument to warm up.

However, the use of a relatively expensive glove box is possible only where sufficient space is available.

Moreover, the duration of the exchange work is still rather long (at least two hours). The reason for this is, firstly, the need for several rinsing processes in order to produce a sufficiently pure protective gas atmosphere within the glove box and these rinsing processes require the consumption of a relatively large amount of protective gas. Another reason is the difficulty of manipulation by means of the gloves in the glove box. Additionally, there exists the danger that the cold side of the displacement element to be replaced, once it has been pulled out, may touch the walls or gloves of the glove box. This would result in destruction of these parts, which are usually made of thin plastic sheets, and thus in contamination of the protective gas atmosphere. The increases in temperature occurring during the exchange work are not negligible, so that start-up times must still be added to the times for the direct exchange work. Finally, the costs connected with the high consumption of protective gas are quite considerable if helium must be employed.

SUMMARY OF THE INVENTION

It is an object of the present invention to provide a method of the above-mentioned type which permits a further, considerable reduction of the expenditures connected with the exchange work.

This is accomplished by the present invention in that during opening of the housing, during exchange of the displacement element and during closing of the housing, a stream of protective gas is maintained in such a manner that undesirable gases are unable to penetrate into the cylinder chamber of the displacement element. The term "displacement element" is understood to also include the displacement system of a two or three-stage refrigerator which is composed of two or three coupled-together displacement stages.

In an operating method of this type, a directed stream of protective gas is maintained, thus effectively preventing the penetration of condensible gases into the area of the displacement element. The use of a glove box can be omitted. Exchange times of 15 minutes or less can be maintained. Even for refrigerators installed in such a manner that access is difficult, a change of displacement elements can be made in the cold state. The changes in temperature occurring during the very short exchange times are insignificant so that, after the change of displacement elements, longer start-up times are no longer necessary.

BRIEF DESCRIPTION OF THE DRAWING

Other advantages and details of the invention will be described below with reference to the appended drawing showing a vertical cross-sectional view of a two-stage refrigerator in accordance with the invention.

DESCRIPTION OF THE PREFERRED EMBODIMENT

The refrigerator 1 shown in the drawing includes a housing composed of two parts 2 and 3. Housing part 2 accommodates a working area consisting of the cylindrical work chambers 4 and 5 for the two displacement stages 6 and 7.

The upper displacement stage 6 is equipped with a drive piston 8 whose associated cylinder 9 is accommodated in a guide bushing 10 which terminates the work chamber 4 toward housing part 3. Guide bushing 10 is equipped with bores 11, 12 and 13. Bores 11 open into work chamber 4 and supply this chamber with working gas. Bore 13 opens into a transverse bore 14 connected with an annular groove 15 in the outer wall of guide bushing 10. Two further bores 12 are indicated by dot-dash lines and serve to pneumatically drive the system composed of displacement elements 6 and 7. The various bores lie in planes which are different from the plane of the drawing so that they do not intersect with one another (which is indicated by the dashed lines and the dot-dash lines).

Control motor 16 is accommodated in housing part 3. Via shaft 17, motor 16 actuates control valve 18. This control valve 18 serves in a known manner to supply the various bores with working gas under high pressure and under low pressure.

The ports for the high pressure working gas and for the low pressure working gas are marked 19 and 20, respectively. The dividing plane 21 between housing parts 2 and 3 lies at the height of control valve 18. This plane has been selected in such a manner that, after removal of the upper housing part 3 including motor 16 and valve 18, a flat, cup-shaped area or chamber 22 defined by the upper side of the bushing 10 and the upper side walls of the work chamber 4 exists above guide bushing 10. At the height of this area 22, there is provided a bore 23 which passes through the wall of housing member 2 and connects area 22 with high pressure port 19. Low pressure port 20 is connected to bore 24 in housing member 2, which opens into annular groove 15 of guide bushing 10.

During operation of the illustrated refrigerator, the working gas, which is under high pressure, flows through port 19 into chamber 22. From there, the various bores are supplied with the aid of control valve 18. After its expansion in the refrigeration stages, the working gas enters bores 13, 14 and flows out through annular groove 15 and low pressure port 20. Customarily, the pressure of the working gas at high pressure port 19 is 22 bar, while the pressure of the working gas at low pressure port 20 is about 7 bar.

According to the invention, the exchange of the displacement system composed of displacement elements 6 and 7 takes place as follows. Compressor ports 19, 20 are disconnected from the refrigerator. They are configured in such a manner that the interior of the refrigerator remains separated from the atmosphere after the ports have been detached. Then a source of protective gas, generally a bottle of helium, is connected to low pressure port 20 and high pressure port 19 is opened. This produces a rinsing flow through bores 24, 14, 13, through chamber 22 and through bore 23. The protective gas is fed in at a slightly elevated pressure, for example at about 1.2 bar. Then, housing member 3 is removed and guide bushing 10 is pulled out of housing member 2. After removal of these two members, the protective gas flowing in through bore 24 flows out upwardly over the edge of housing member 2. This constant stream is directed opposite to the incoming stream of condensing gases so that, even after removal of displacement element 6, 7 to be exchanged, the influx of undesirable gases into the working area of the element 6, 7, that is, the displacement element chamber 4, 5, is effectively avoided. The lowest possible (furthest inward of the chamber 4, 5 and thus closest to the bottom closed end of chamber 5) location of the point where the protective gas flows in (bore 24) is here of significance. Therefore, the low pressure gas port is disposed closest to the bottom closed end of chamber 5 and thus between high pressure gas port and the bottom end of chamber 5.

After insertion of the new displacement system, which advisably has previously been rinsed with helium, and replacement of guide bushing 10, housing member 3 is mounted while maintaining a constant flow of protective gas. Then the refrigerator is ready for operation.

What is claimed is:

1. A method of exchanging a displacement element in a working area in a divided housing of a refrigerator, the housing having parts which are separable so as to provide access to the displacement element therein, the method comprising the steps of:

a. opening the housing by separating the parts of the housing, so as to access the displacement element therein;

b. following said step of opening, exchanging the displacement element therein for another displacement element;

c. closing the housing; and d. during said steps of opening, exchanging and closing, maintaining a stream of protective gas which shields the working area from undesired gases.

2. A method as in claim 1, further comprising the steps of a. using helium as a working gas in the refrigerator;

b. using the working gas as the protective gas; and c. during said step of maintaining a stream, supplying the stream of protective gas to a low pressure gas port of the refrigerator.

3. A method as in claim 2, further comprising the step of maintaining, in the absence of pressure from the working gas at a high pressure gas port of the refrigerator, the stream of protective gas from the low pressure gas port toward the high pressure gas port, from a time prior to the opening of the housing.

* * * * *